US008286457B2

(12) United States Patent
Chen et al.

(10) Patent No.: US 8,286,457 B2
(45) Date of Patent: Oct. 16, 2012

(54) METHOD FOR CONTROLLING VARIATIONS OF AL—TI—B ALLOY GRAIN REFINEMENT ABILITY THROUGH CONTROLLING COMPRESSION RATIO

(75) Inventors: Xuemin Chen, Guangdong (CN); Qingdong Ye, Guangdong (CN); Jianguo Li, Guangdong (CN); Chaowen Liu, Guangdong (CN); Yueming Yu, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 169 days.

(21) Appl. No.: 12/867,150

(22) PCT Filed: May 10, 2010

(86) PCT No.: PCT/CN2010/072547

§ 371 (c)(1),
(2), (4) Date: Aug. 11, 2010

(87) PCT Pub. No.: WO2011/022984

PCT Pub. Date: Mar. 3, 2011

(65) Prior Publication Data

US 2011/0192208 A1 Aug. 11, 2011

(30) Foreign Application Priority Data

Feb. 5, 2010 (CN) ..... 2010 1 0110068

(51) Int. Cl.
*B21B 3/00* (2006.01)

(52) U.S. Cl. ..... 72/199

(58) Field of Classification Search ..... 72/199–252.5
See application file for complete search history.

(56) References Cited

U.S. PATENT DOCUMENTS 5,025,547 A * 6/1991 Sheu et al. ..... 29/527.4
6,790,387 B1 * 9/2004 Ball et al. ..... 264/1.1

* cited by examiner

*Primary Examiner* — Faye Francis
(74) *Attorney, Agent, or Firm* — Jackson IPG PLLC

(57) ABSTRACT

A method for controlling variations of Al—Ti—B alloy crystal grain refinement ability through controlling a compression ratio of sectional area of Al—Ti—B alloy including: A. establishing a relationship between variations of refinement ability of Al—Ti—B alloy crystal grain and parameters of press process of the Al—Ti—B alloy; setting the parameters of press process and controlling the variation of the refinement ability of the Al—Ti—B alloy crystal grain through controlling a value of the compression ratio.

3 Claims, 3 Drawing Sheets

METHOD FOR CONTROLLING VARIATIONS OF AL—TI—B ALLOY GRAIN REFINEMENT ABILITY THROUGH CONTROLLING COMPRESSION RATIO

The present invention relates to processing techniques, especially relates to a method for controlling variations of Al(aluminum)-Ti(titanium)-B(boron) alloy crystal grain refinement through controlling a ratio of sectional area of Al—Ti—B alloy before press processing to after press processing (namely compression ratio) during a production of the Al—Ti—B alloy.

GENERAL BACKGROUND

Currently, Al—Ti—B alloy is much popularly employing in Al material machining as a most efficient preliminary alloy for Al and Al alloy coagulation crystal grain refinement. A refinement ability of the Al—Ti—B alloy crystal grain is a very important factor when judging a quality of Al processing material. Usually, the better the Al—Ti—B alloy crystal grain refinement ability is, the higher yield strength and the better malleability of the Al material are. Therefore, the Al—Ti—B alloy manufacturers and research organizations are forward into developing improvements of the Al—Ti—B alloy crystal grain refinement ability. The US aluminum association has specially ruled an AA value to represent the crystal grain refinement ability. The AA value is a value that can be used for measuring the Al—Ti—B alloy crystal grain refinement ability, and the lesser the AA value is, the better the refinement ability of the Al—Ti—B alloy is. That is, the lesser AA value that the Al—Ti—B alloy added during Al and Al alloy producing process has, the more refined the crystal grain of the Al and Al alloy are. With a development of the process and refinement technology, the AA value is decreased from 250 at very beginning to 170. Presently, alloy fabrication technology is focused on material components, melting process, and such like. However, a quality control during a press process of the Al—Ti—B alloy has been ignored or indifferent to people. The press process includes mill rolling and cast extrusion machine extruding, and many believe that a ratio of the sectional area before press process to that after press process (defined as compression ratio), a variation of temperatures before and after press process, a line speed at exit, and a quantity of the standers have relations with the refinement ability of the Al—Ti—B alloy crystal grain, and there is no quantitative optimal control method for control the refinement ability of the Al—Ti—B alloy crystal grain through these respects including compression ratio.

What is needed, therefore, is a method for controlling variations of Al—Ti—B alloy crystal grain refinement ability through controlling a compression ratio of sectional area of Al—Ti—B alloy that can overcome the above-described deficiencies.

SUMMARY

It is an object of the present invention to provide a method for controlling variations of Al—Ti—B alloy crystal grain refinement ability through controlling a compression ratio of sectional area of Al—Ti—B alloy.

One exemplary embodiment of the present invention is a method for controlling variations of Al—Ti—B alloy crystal grain refinement ability through controlling a compression ratio of sectional area of Al—Ti—B alloy including: A. establishing a relationship between variations of refinement ability of Al—Ti—B alloy crystal grain and parameters of press process of the Al—Ti—B alloy; setting the parameters of press process and controlling the variation of the refinement ability of the Al—Ti—B alloy crystal grain through controlling a value of the compression ratio.

Other novel features and advantages will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment of the present invention. In the drawings, like reference numerals designate corresponding parts throughout various views, and all the views are schematic.

DETAILED DESCRIPTION OF PREFERRED EMBODIMENTS

Figure 1:
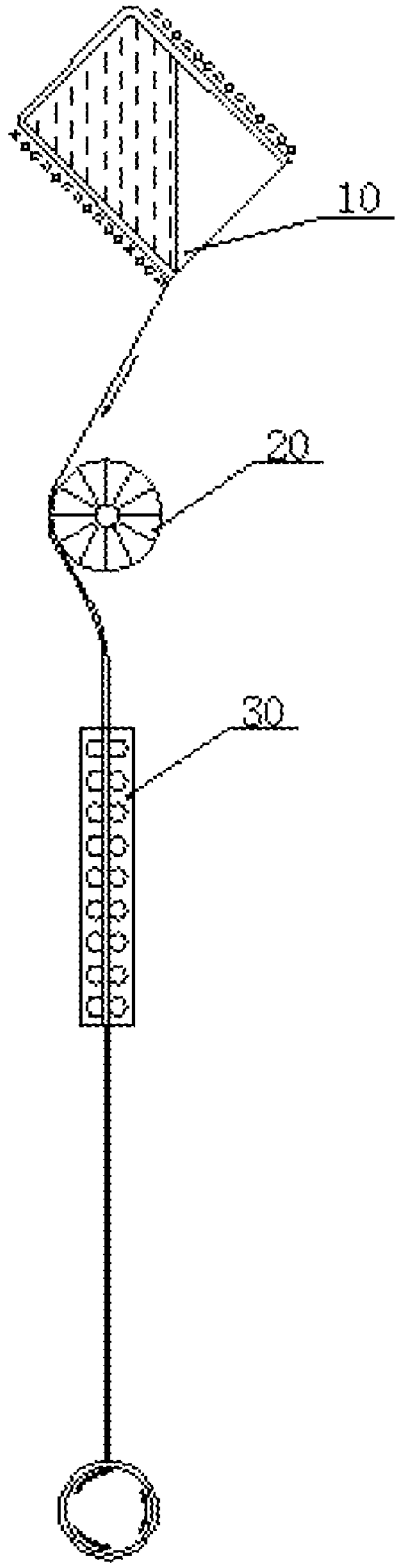
FIG. 1 is a schematic view of continuous casting and tandem rolling manufacturing process employing a method for controlling variations of Al—Ti—B alloy crystal grain refinement ability through controlling a compression ratio of sectional area of Al—Ti—B alloy according to an exemplary embodiment of the present invention.

Reference will now be made to the drawings to describe preferred and exemplary embodiments in detail.

It has been proved that during a press process of the Al—Ti—B alloy, a pressure parameter of the press process is directly related with the refinement ability of the Al—Ti—B alloy crystal grain by experiments conducted by inventors of the present application using continuous casting and tandem rolling machines, and continuous casting and continuous extruding machines. The pressure parameter is closely relevant to the refinement ability of the Al—Ti—B alloy crystal grain. The following is a table 1 showing part of the experiments data.

TABLE 1

| $S_1$ (mm$^2$) | $S_2$ (mm$^2$) | $D = \frac{S_1}{S_2}$ | ΔT(° C.) | V (m/s) | n | ΔAA | $AA_1$ | $AA_2$ |
|---|---|---|---|---|---|---|---|---|
| 760 | 70.8 | 10.7 | 3 | 3 | 7 | 11.6 | 130 | 118 |
| 780 | 70.8 | 11.0 | 3 | 3 | 7 | 11.9 | 130 | 118 |
| 800 | 70.8 | 11.3 | 3 | 3 | 7 | 12.2 | 130 | 118 |
| 960 | 70.8 | 13.6 | 3 | 3 | 7 | 14.6 | 130 | 115 |
| 980 | 70.8 | 13.8 | 3 | 3 | 7 | 14.9 | 130 | 115 |
| 1000 | 70.8 | 14.1 | 3 | 3 | 7 | 15.2 | 130 | 115 |
| 1160 | 70.8 | 16.4 | 3 | 3 | 7 | 17.7 | 130 | 112 |
| 1180 | 70.8 | 16.7 | 3 | 3 | 7 | 18.0 | 130 | 112 |
| 1200 | 70.8 | 16.9 | 3 | 3 | 7 | 18.3 | 130 | 112 |
| 760 | 70.8 | 10.7 | 4 | 6 | 8 | 15.2 | 130 | 115 |
| 780 | 70.8 | 11.0 | 4 | 6 | 8 | 15.6 | 130 | 114 |
| 800 | 70.8 | 11.3 | 4 | 6 | 8 | 16.0 | 130 | 114 |
| 960 | 70.8 | 13.6 | 4 | 6 | 8 | 19.2 | 130 | 111 |
| 980 | 70.8 | 13.8 | 4 | 6 | 8 | 19.6 | 130 | 110 |
| 1000 | 70.8 | 14.1 | 4 | 6 | 8 | 20.0 | 130 | 110 |
| 1160 | 70.8 | 16.4 | 4 | 6 | 8 | 23.2 | 130 | 107 |
| 1180 | 70.8 | 16.7 | 4 | 6 | 8 | 23.6 | 130 | 106 |
| 1200 | 70.8 | 16.9 | 4 | 6 | 8 | 24.0 | 130 | 106 |
| 760 | 70.8 | 10.7 | 5 | 9 | 10 | 14.6 | 130 | 115 |
| 780 | 70.8 | 11.0 | 5 | 9 | 10 | 15.0 | 130 | 115 |
| 800 | 70.8 | 11.3 | 5 | 9 | 10 | 15.4 | 130 | 115 |
| 960 | 70.8 | 13.6 | 5 | 9 | 10 | 18.4 | 130 | 112 |
| 980 | 70.8 | 13.8 | 5 | 9 | 10 | 18.8 | 130 | 111 |
| 1000 | 70.8 | 14.1 | 5 | 9 | 10 | 19.2 | 130 | 111 |
| 1160 | 70.8 | 16.4 | 5 | 9 | 10 | 22.3 | 130 | 108 |
| 1180 | 70.8 | 16.7 | 5 | 9 | 10 | 22.7 | 130 | 107 |
| 1200 | 70.8 | 16.9 | 5 | 9 | 10 | 23.0 | 130 | 107 |

There is an international standard for the Al—Ti—B alloy production that the final product of the Al—Ti—B alloy should have a diameter of 9.5 mm, that is a sectional area of 70.8 mm$^2$. Contents of table 1 is part of experiments data conducted by continuous casting and tandem rolling machines using a method for controlling variations of Al—Ti—B alloy crystal grain refinement ability through controlling a compression ratio of sectional area of Al—Ti—B alloy according to an exemplary embodiment of the present invention. The continuous casting and tandem rolling machines includes a rolling mill 30 and a cooling module for Al—Ti—B alloy during a cooling press process. The cooling module includes a temperature sensor for detecting a temperature before the press process of the Al—Ti—B alloy and a temperature after the press process of the Al—Ti—B alloy. The press process of the Al—Ti—B alloy is completed through a cooperation of two rollers 31 of the rolling mill 30, and the Al—Ti—B alloy maintains solid state before, after, and during the press process. During the press process, there are two points of temperatures that one point of the temperature is before the pressure being imposed and the other point of the temperature is after the pressure being released. Before the pressure being imposed, an instantaneous temperature of the Al—Ti—B alloy is about the same as an input temperature, and after the pressure being released, an instantaneous temperature of Al—Ti—B alloy is about the same as an output temperature, therefore it is convenient to detect temperatures of the two points.

Figure 3:
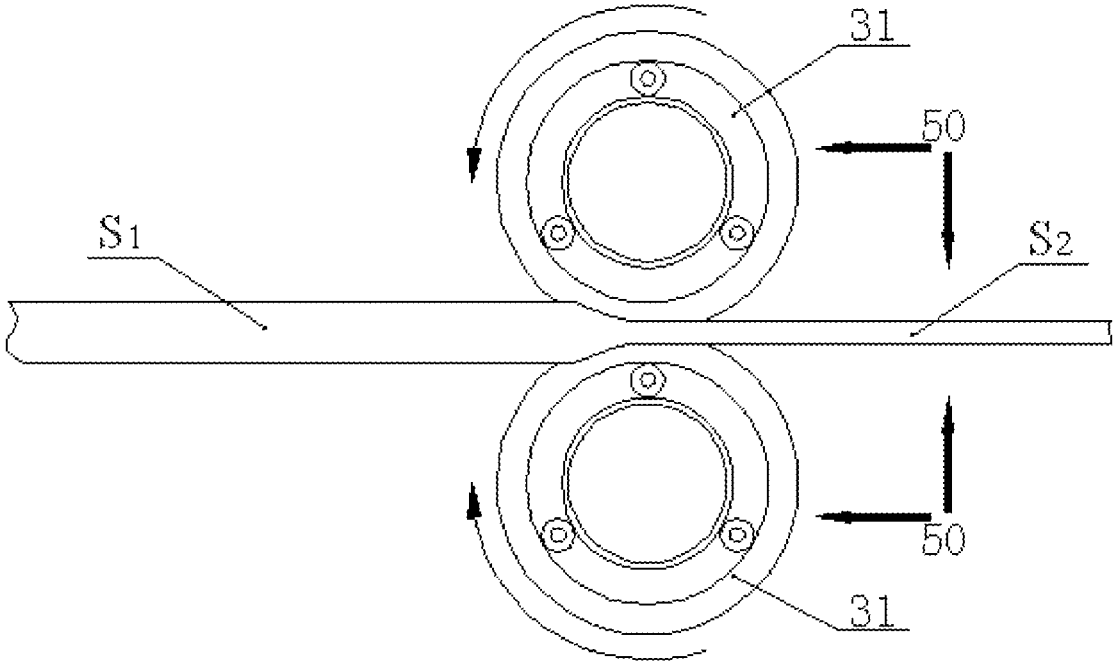
FIG. 3 is a schematic, plane structural view of part of a rolling mill used for the method for controlling variations of Al—Ti—B alloy crystal grain refinement ability through controlling a compression ratio of sectional area of Al—Ti—B alloy.

Referring to FIG. 1, Al—Ti—B alloy melt is put into a crystallize wheel 20 from a crucible 10 thereby forming an Al—Ti—B alloy bar. Thereafter, the bar-shaped Al—Ti—B alloy is put into the rolling mill 30 to conduct press process. An amount of standers of the rolling mill 30 could be 3, 4, 5, 6, 7, 8, 9 or 10. In the illustrated embodiment as shown in FIG. 1, an amount of standers of the rolling mill 30 is 10. Referring to FIG. 3, one stand of the rolling mill 30 is shown in enlarged view. The two rollers 31 of the rolling mill 30 are rolling inward and toward each other. $S_1$ is denoted for the sectional area before press process, and $S_2$ is denoted for the sectional area after the press process. There are at least two temperature sensors provided therein, which are configured to detect the temperature of the Al—Ti—B alloy before the press process and the temperature of the Al—Ti—B alloy after the press process. A scope of temperatures of the Al—Ti—B alloy before the press process is between 300° C.-450° C. The temperature of the Al—Ti—B alloy is raised when being processed in the rolling mill 30. The cooling module is configured for spraying cooling fluid 50 onto the rollers 31 of the rolling mill 30. By controlling a flow rate of the cooling fluid 50, a temperature difference ΔT of the Al—Ti—B alloy before the press process and after the press process can be controlled within a proper range. In the illustrated embodiment, the cooling fluid 50 can be water. The Al—Ti—B alloy comes out from the rolling mill 30 and forms an Al—Ti—B alloy rod.

From the data shown in table 1, the relation between the parameters of the press process and the refinement ability variation ΔAA can be conclude as the formula described below:

$$\Delta AA = K \cdot D \cdot V / (\Delta T \cdot n)$$

In the formula, $\Delta AA = AA_1 - AA_2$, wherein $AA_1$ represents a refinement ability value of the Al—Ti—B alloy before the press process, $AA_2$ represents a refinement ability value of the Al—Ti—B alloy after the press process. K is a constant and can be calculated according the data of table 1 to be 7.55. D represents the compression ratio, and $D = S_1/S_2$, $S_1$ is denoted for the sectional area before press process, and $S_2$ is denoted for the sectional area after the press process. ΔT represents a temperature variation of the Al—Ti—B alloy before the press process and after the press process. V represents a line speed of the outlet, and $V = 3\Delta T - 6$, $V \geqslant 1$ m/s. Currently the line speed V can reach high up to 30 m/s. N represents the number of the standers of the rolling mill 30.

The above-mentioned formula $\Delta AA = K \cdot D \cdot V / (\Delta T \cdot n)$ is applicable to both single stander and a plurality of standers, that is, whether the computation is for total standers or for single stander, the formula is applicable. When n=1, the computation means for the last one of the standers, and the sectional area of the Al—Ti—B alloy products output from the last stander is 70.8 $mm^2$.

In the production of the Al—Ti—B alloy, the press process parameters including temperature variation ΔT, line speed of the outlet V, and the amount of the standers are normally fixed, and through controlling on the compression ratio of the press process of the Al—Ti—B alloy, the refinement ability variation ΔAA can be controlled precisely. As shown in table 1, when ΔT=4° C., V=6 m/s, and n=8, by controlling the compression ratio D from 10.7 to 16.9, the refinement ability ΔAA can raised from 15.2 up to 24.0, and when the $AA_1$ value maintains at 130, the $AA_2$ value can be changed from 115 to 106.

TABLE 2

| $S_1$ ($mm^2$) | $S_2$ ($mm^2$) | $D = \frac{S_1}{S_2}$ | ΔT(° C.) | V (m/s) | n | ΔAA | $AA_1$ | $AA_2$ |
|---|---|---|---|---|---|---|---|---|
| 760 | 70.8 | 10.7 | 149 | 3 | 1 | 1.6 | 130 | 128 |
| 780 | 70.8 | 11.0 | 149 | 3 | 1 | 1.7 | 130 | 128 |
| 800 | 70.8 | 11.3 | 149 | 3 | 1 | 1.7 | 130 | 128 |
| 960 | 70.8 | 13.6 | 149 | 3 | 1 | 2.1 | 130 | 128 |
| 980 | 70.8 | 13.8 | 149 | 3 | 1 | 2.1 | 130 | 128 |
| 1000 | 70.8 | 14.1 | 149 | 3 | 1 | 2.1 | 130 | 128 |
| 1160 | 70.8 | 16.4 | 149 | 3 | 1 | 2.5 | 130 | 128 |
| 1180 | 70.8 | 16.7 | 149 | 3 | 1 | 2.5 | 130 | 127 |
| 1200 | 70.8 | 16.9 | 149 | 3 | 1 | 2.6 | 130 | 127 |
| 1360 | 70.8 | 19.2 | 149 | 3 | 1 | 2.9 | 130 | 127 |
| 1380 | 70.8 | 19.5 | 149 | 3 | 1 | 3.0 | 130 | 127 |
| 1400 | 70.8 | 19.8 | 149 | 3 | 1 | 3.0 | 130 | 127 |
| 760 | 70.8 | 10.7 | 150 | 4 | 1 | 2.2 | 130 | 128 |
| 780 | 70.8 | 11.0 | 150 | 4 | 1 | 2.2 | 130 | 128 |
| 800 | 70.8 | 11.3 | 150 | 4 | 1 | 2.3 | 130 | 128 |
| 960 | 70.8 | 13.6 | 150 | 4 | 1 | 2.7 | 130 | 127 |
| 980 | 70.8 | 13.8 | 150 | 4 | 1 | 2.8 | 130 | 127 |
| 1000 | 70.8 | 14.1 | 150 | 4 | 1 | 2.8 | 130 | 127 |
| 1160 | 70.8 | 16.4 | 150 | 4 | 1 | 3.3 | 130 | 127 |
| 1180 | 70.8 | 16.7 | 150 | 4 | 1 | 3.4 | 130 | 127 |
| 1200 | 70.8 | 16.9 | 150 | 4 | 1 | 3.4 | 130 | 127 |
| 1360 | 70.8 | 19.2 | 150 | 4 | 1 | 3.9 | 130 | 126 |
| 1380 | 70.8 | 19.5 | 150 | 4 | 1 | 3.9 | 130 | 126 |
| 1400 | 70.8 | 19.8 | 150 | 4 | 1 | 4.0 | 130 | 126 |
| 760 | 70.8 | 10.7 | 149 | 5 | 1 | 2.7 | 130 | 127 |
| 780 | 70.8 | 11.0 | 149 | 5 | 1 | 2.8 | 130 | 127 |
| 800 | 70.8 | 11.3 | 149 | 5 | 1 | 2.9 | 130 | 127 |
| 960 | 70.8 | 13.6 | 149 | 5 | 1 | 3.4 | 130 | 127 |
| 980 | 70.8 | 13.8 | 149 | 5 | 1 | 3.5 | 130 | 126 |
| 1000 | 70.8 | 14.1 | 149 | 5 | 1 | 3.6 | 130 | 126 |
| 1160 | 70.8 | 16.4 | 149 | 5 | 1 | 4.2 | 130 | 126 |
| 1180 | 70.8 | 16.7 | 149 | 5 | 1 | 4.2 | 130 | 126 |
| 1200 | 70.8 | 16.9 | 149 | 5 | 1 | 4.3 | 130 | 126 |
| 1360 | 70.8 | 19.2 | 149 | 5 | 1 | 4.9 | 130 | 125 |
| 1380 | 70.8 | 19.5 | 149 | 5 | 1 | 4.9 | 130 | 125 |
| 1400 | 70.8 | 19.8 | 149 | 5 | 1 | 5.0 | 130 | 125 |
| 760 | 70.8 | 10.7 | 151 | 6 | 1 | 3.2 | 130 | 127 |
| 780 | 70.8 | 11.0 | 151 | 6 | 1 | 3.3 | 130 | 127 |
| 800 | 70.8 | 11.3 | 151 | 6 | 1 | 3.4 | 130 | 127 |
| 960 | 70.8 | 13.6 | 151 | 6 | 1 | 4.1 | 130 | 126 |
| 980 | 70.8 | 13.8 | 151 | 6 | 1 | 4.2 | 130 | 126 |
| 1000 | 70.8 | 14.1 | 151 | 6 | 1 | 4.2 | 130 | 126 |
| 1160 | 70.8 | 16.4 | 151 | 6 | 1 | 4.9 | 130 | 125 |
| 1180 | 70.8 | 16.7 | 151 | 6 | 1 | 5.0 | 130 | 125 |
| 1200 | 70.8 | 16.9 | 151 | 6 | 1 | 5.1 | 130 | 125 |
| 1360 | 70.8 | 19.2 | 151 | 6 | 1 | 5.8 | 130 | 124 |
| 1380 | 70.8 | 19.5 | 151 | 6 | 1 | 5.8 | 130 | 124 |
| 1400 | 70.8 | 19.8 | 151 | 6 | 1 | 5.9 | 130 | 124 |

Contents of table 2 is part of experiments data conducted by continuous casting and continuous extruding machines designed by the applicant and using a method for controlling variations of Al—Ti—B alloy crystal grain refinement ability through controlling a compression ratio of sectional area of Al—Ti—B alloy according to an exemplary embodiment of the present invention. The continuous casting and continuous extruding machines includes a casting extrusion machine 40 and a cooling module for Al—Ti—B alloy during a cooling press process. The press process of the Al—Ti—B alloy is competed in a roller of the casting extrusion machine 40. The Al—Ti—B alloy maintains solid state before, after, and during the press process. During the press process, there are two points of temperatures that one point of the temperature is before the pressure being imposed and the other point of the temperature is after the pressure being released. Before the pressure being imposed, an instantaneous temperature of the Al—Ti—B alloy is about the same as an friction heat temperature, and after the pressure being released, an instantaneous temperature of Al—Ti—B alloy is about the same as an temperature outputted from the casting extrusion machine 40, therefore it is convenient to detect temperatures of the two points.

Figure 2:
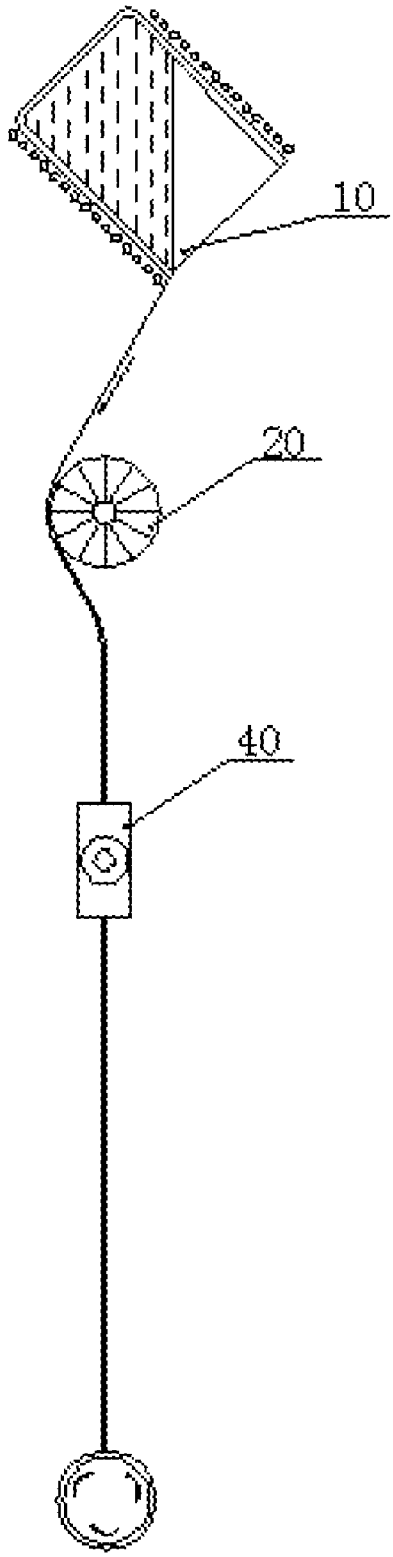
FIG. 2 is a schematic view of continuous casting and continuous extruding manufacturing process employing the method for controlling variations of Al—Ti—B alloy crystal grain refinement ability through controlling a compression ratio of sectional area of Al—Ti—B alloy.

Referring to FIG. 2, Al—Ti—B alloy melt is put into a crystallize wheel 20 from a crucible 10 thereby forming an Al—Ti—B alloy bar. Thereafter, the bar-shaped Al—Ti—B alloy is put into the casting extrusion machine 40 to conduct press process.

Figure 4:
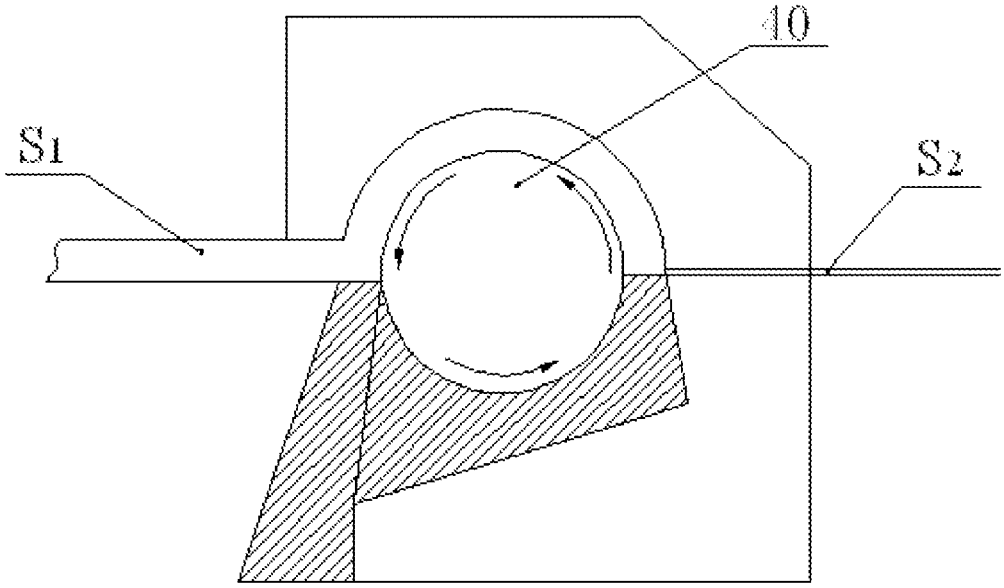
FIG. 4 is a schematic, plane structural view of a cast extrusion machine used for the method for controlling variations of Al—Ti—B alloy crystal grain refinement ability through controlling a compression ratio of sectional area of Al—Ti—B alloy.

Referring to FIG. 2, Al—Ti—B alloy melt is put into a crystallize wheel 20 from a crucible 10 thereby forming an Al—Ti—B alloy bar. Thereafter, the bar-shaped Al—Ti—B alloy is put into the casting extrusion machine 40 to conduct press process. An amount of the standers of the casting extrusion machine 40 is as shown in FIG. 2. Referring to FIG. 4, $S_1$ is denoted for the sectional area before press process, and $S_2$ is denoted for the sectional area after the press process. There are at least two temperature sensors provided therein, which are configured to detect the temperature of the Al—Ti—B alloy before the press process and the temperature of the Al—Ti—B alloy after the press process. The temperature of the Al—Ti—B alloy is raised when being processed in the casting extrusion machine 40 and the Al—Ti—B alloy is altered into semifluid. The cooling module spraying cooling fluid into the casting extrusion machine 40. By controlling a flow rate of the cooling fluid, a temperature difference ΔT of the Al—Ti—B alloy before the press process and after the press process can be controlled within a proper range. In the illustrated embodiment, the cooling fluid can be water. The Al—Ti—B alloy comes out from the casting extrusion machine 40 and forms an Al—Ti—B alloy rod.

From the data shown in table 1, the relation between the parameters of the press process and the refinement ability variation ΔAA can be conclude as the formula described below:

$$\Delta AA = K \cdot D \cdot V / (\Delta T \cdot n)$$

In the formula, $\Delta AA = AA_1 - AA_2$, wherein $AA_1$ represents a refinement ability value of the Al—Ti—B alloy before the press process, $AA_2$ represents a refinement ability value of the Al—Ti—B alloy after the press process. K is a constant and can be calculated according the data of table 1 to be 5.13. D represents the compression ratio, and $D = S_1/S_2$, $S_1$ is denoted for the sectional area before press process, and $S_2$ is denoted for the sectional area after the press process. ΔT represents a temperature variation of the Al—Ti—B alloy before the press process and after the press process. V represents a line speed of the outlet. N represents the number of the standers of the casting extrusion machine 40, and n=1.

The above-mentioned formula $\Delta AA = K \cdot D \cdot V / (\Delta T \cdot n)$ is applicable to casting extrusion machine 40 with single stander. When n=1, the computation means for the last one of the standers, and the sectional area of the Al—Ti—B alloy products output from the last stander is 70.8 $mm^2$.

In the production of the Al—Ti—B alloy, the press process parameters including temperature variation ΔT, line speed of the outlet V, and the amount of the standers are normally fixed, and through controlling on the compression ratio of the press process of the Al—Ti—B alloy, the refinement ability variation ΔAA can be controlled precisely. As shown in table 2, when ΔT=150° C., V=4 m/s, and n=1, by controlling the compression ratio D from 10.7 to 19.8, the refinement ability ΔAA can raised from 2.2 to 4.0, and when the $AA_1$ value maintains at 130, the $AA_2$ value can be changed from 128 to 126.

The method for controlling variations of Al—Ti—B alloy crystal grain refinement ability through controlling a compression ratio of sectional area of Al—Ti—B alloy has overcome the deficiencies of conventional technique for Al—Ti—B alloy process, and proved that variations of the refinement ability can be controlled through controlling a compression ratio of sectional area of Al—Ti—B alloy. By adopting the present invention, with the parameters of press process, the temperature variation before and after the press process, the line speed of outlet, and the amount of the standers being set fixed, the variations of the refinement ability of Al—Ti—B alloy crystal grain can be precisely controlled by controlling the compression ratio. The greater the variation is, the better the refinement ability of Al—Ti—B alloy crystal grain is with a certain AA value before the press process and a lesser AA value after the press process.

It is to be understood, however, that even though numerous characteristics and advantages of exemplary and preferred embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for controlling variations of Al—Ti—B alloy crystal grain refinement ability through controlling a compression ratio of a cross-sectional area of Al—Ti—B alloy comprising:

feeding a Al—Ti—B alloy into a rolling mill having one or more sets of two rollers rotating inward towards each other to be pressed into a shape in a press process;

measuring the temperature of the alloy before and after it passes through the rollers;

using a cooling module to spray coolant onto the rollers to control the temperature of the rollers and thus the alloy, thereby controlling the difference in temperature (ΔT) between the alloy entering and leaving the rolling mill by manipulating the rate at which the coolant is sprayed onto the rollers such that the alloy temperature stays within a range of temperatures;

measuring the cross sectional area of the alloy before (S1) and after (S2) it is pressed by the rolling mill thereby calculating the compression ratio (D) using the equation $D = S_1/S_2$;

varying the speed (V) at which the alloy moves through the rolling mill;

altering the number of rollers (n) in the rolling mill; and producing a finished processed piece of Al—Ti—B alloy with a desired crystal grain refinement ability (ΔAA) by establishing a relationship between D, V, ΔT, and n and the crystal grain refinement ability of the alloy represented by the following equation: $\Delta AA = K \cdot D \cdot V / (\Delta T \cdot n)$, wherein K is a constant whose value is 7.55 and wherein ΔAA=AA1−AA2 with AAI represents a refinement ability value of the Al—Ti—B alloy before the press process and AA2 representing a refinement ability value of the Al—Ti—B alloy after the press process.

2. The method of claim 1 wherein, the rolling mill consists of continuous casting and tandem rolling machines.

3. The method of claim 1 wherein, the rolling mill consists of continuous casting and continuous extruding machines.

* * * * *